US007866539B2

(12) United States Patent
Senftner et al.

(10) Patent No.: US 7,866,539 B2
(45) Date of Patent: Jan. 11, 2011

(54) CONTAINER FOR TRANSPORTING COOLED GOODS

(75) Inventors: Gottfried Senftner, Lampertheim (DE); Peter Wigand, Rimbach (DE)

(73) Assignee: Roche Diagnostics Operations, Inc., Indianapolis, IN (US)

( * ) Notice: Subject to any disclaimer, the term of this patent is extended or adjusted under 35 U.S.C. 154(b) by 77 days.

(21) Appl. No.: 12/249,177

(22) Filed: Oct. 10, 2008

(65) Prior Publication Data

US 2009/0095798 A1 Apr. 16, 2009

Related U.S. Application Data

(63) Continuation of application No. PCT/EP2007/053504, filed on Apr. 11, 2007.

(30) Foreign Application Priority Data

Apr. 12, 2006 (EP) ..... 06112545

(51) Int. Cl.
*B65D 5/60* (2006.01)
*B65D 81/38* (2006.01)
*F25D 3/08* (2006.01)

(52) U.S. Cl. ..... 229/103.11; 62/457.1; 62/457.2; 220/592.1; 220/592.25; 220/676; 220/902

(58) Field of Classification Search ..... 229/103.11; 220/495.04, 592.09, 592.1, 592.15, 592.2, 220/592.23, 592.25, 676, 902; 62/457.1, 62/457.2
See application file for complete search history.

(56) References Cited

U.S. PATENT DOCUMENTS

| | | | | |
|---|---|---|---|---|
| 634,868 | A * | 10/1899 | Benson | 62/457.1 |
| 1,238,364 | A * | 8/1917 | Kulenkampff | 229/103.11 |
| 1,429,887 | A * | 9/1922 | Kulenkampff | 220/592.15 |
| 1,911,969 | A * | 5/1933 | Prendergast | 220/592.25 |
| 2,326,817 | A * | 8/1943 | Zalkind | 229/103.11 |
| 2,477,787 | A * | 8/1949 | Cook, Jr. | 229/103.11 |
| 2,828,903 | A * | 4/1958 | Adkins | 229/103.11 |
| 3,121,522 | A * | 2/1964 | Ragnow | 220/592.25 |
| 5,105,970 | A * | 4/1992 | Malone et al. | 220/592.25 |
| 5,551,592 | A * | 9/1996 | Barton et al. | 220/592.25 |
| 5,979,693 | A * | 11/1999 | Bane, III | 220/592.2 |
| 6,189,330 | B1 * | 2/2001 | Retallick et al. | 62/457.7 |
| 6,718,776 | B2 * | 4/2004 | Wessling et al. | 62/60 |
| 6,758,363 | B2 * | 7/2004 | Stokes | 220/592.15 |
| 2005/0006272 | A1 | 1/2005 | Derifield | |
| 2005/0217311 | A1 * | 10/2005 | Armer et al. | 62/457.2 |

FOREIGN PATENT DOCUMENTS

| | | | |
|---|---|---|---|
| DE | 202004016969 | U1 | 3/2005 |
| EP | 0711964 | A1 | 7/1995 |
| EP | 1112946 | A1 | 12/1999 |
| WO | 9427871 | | 12/1994 |

* cited by examiner

*Primary Examiner*—Gary E Elkins
(74) *Attorney, Agent, or Firm*—Dinsmore & Shohl LLP

(57) ABSTRACT

The invention refers to a container for transporting cooled goods, comprising an inner container for receiving the cooled goods and an outer container surrounding the inner container. The inner container contains a thermally insulating material and has an outer surface on which outer ribs are arranged. The outer ribs generate spaces between the inner container and the outer container. The outer container has a plurality of ventilation holes for ventilating the spaces.

8 Claims, 4 Drawing Sheets

CONTAINER FOR TRANSPORTING COOLED GOODS

CROSS REFERENCE TO RELATED APPLICATIONS

This application is a continuation of International application PCT/EP2007/053504, having a filing date of Apr. 11, 2007, which claims priority to European Application No. 06112545.6, filed Apr. 12, 2006.

FIELD OF THE INVENTION

The invention relates to a container for transporting cooled goods, and more particularly to a container for transporting thermally sensitive, high-quality industrial goods like pharmaceutical or diagnostic products.

Such containers are filled with goods and a coolant (e.g. dry ice, freezer packs or cooling gel packs) for a temporary storage and transport of the goods. The containers are closed and then transported e.g. by a truck, a ship or a plane to the destination of the goods.

BACKGROUND OF THE INVENTION

In prior art diverse containers for transporting cooled goods are known.

DE 20 2004 016 939 U1 refers to a portable, thermally insulating transport container with a double-wall body into a space of which insulating material is placed.

EP 0 711 964 A1 concerns a container for preserving and transporting perishable goods, comprising a body provided with walls of insulating material and into which a casing of high thermal capacity is introduced, the casing covering the inner sides of the walls of the insulating body.

US 2005/0006272 A1 refers to a shipping container for holding temperature sensitive products and a coolant in a predetermined relationship to maintain a cooled or frozen condition for an extended period of time. The shipping container comprises a container having a base, four walls and a top, the base being capable of supporting a temperature sensitive product. The shipping container further comprises a removable coolant tray being disposable within the container above the product and for receiving thereon coolant packages.

WO 94/27871 A1 concerns an insulating system for insertion into an outer shipping container whereby the thermal insulating characteristics of the container are increased so as to allow shipment of goods having elevated or decreased temperatures with respect to an ambient temperature. The insulating system comprises an inner shipping container for insertion into the outer shipping container. At least one spacer insert is inserted between the outer shipping container and the inner shipping container, whereby a first pocket of air is provided in contact with at least a portion of an exterior surface of the inner shipping container. An inner liner is inserted into the inner shipping container, the inner liner being comprised of a layer of thermal reflective radiant barrier material encased within a sealed air-tight pouch of durable material such that a second pocket of air is provided between an inner surface of the durable material and an outer surface of a radiant barrier material.

The containers known in prior art were constructed for optimizing the cooled storage of the goods contained therein over a long period of time. However, these containers frequently have the drawback, that with a temperature below the freezing point inside of the container, the exterior walls of the container also have a temperature below 0° C. Therefore, when this container is transported, goods or other containers in the surrounding of this container are cooled or even frozen. Frequently this is not desirable or even damaging for the goods neighboring the container with the cooled goods.

SUMMARY OF THE INVENTION

The present invention avoids the disadvantages of the prior art by providing a container for transporting cooled goods, especially frozen goods, which prevents a temperature transfer from the inside of the container to its outer walls.

In one embodiment there is disclosed a container for transporting cooled goods comprising an inner container or receiving the cooled goods and an outer container surrounding the inner container, wherein the inner container contains a thermally insulating material and has an outer surface, on which outer surface outer ribs are arranged. The outer ribs generate spaces between the inner container and the outer container. The outer container has a plurality of ventilation holes for ventilating these spaces.

The function of the inner container is to hold the goods to be transported and a coolant (e.g. dry ice, cooling packs, cooling gel packs or the like) within an internal space. It keeps these goods in a cooled, particularly in a frozen state as a result of its thermally insulating properties. On its outer surface this inner container has outer ribs, which work as spacers, when the inner container is placed within the outer container. In another embodiment the outer ribs of the inner container abut an inner surface of the outer container.

The outer container has a plurality of ventilation holes. These holes in one embodiment are distributed over all of the walls (including side walls, base and top) of the outer container. They can have for example a triangular, a quadrangular, a circular or any other form. The ventilation holes are provided for ventilating the spaces between the inner container and the outer container, which are generated by the ribs. In another embodiment the ribs are arranged at positions, which are shifted with respect to the ventilation holes. Thereby the ribs of the inner container and the ventilation holes of the outer container do not overlap, permitting an optimal ventilation of the spaces.

Via the ventilation holes of the container according to the invention the ventilation of the spaces with air from the surrounding of the container can be achieved. This ventilation provides for a constant adjustment of the temperature in the spaces between the inner container and the outer container depending on a temperature of the air. Thereby the temperature of the exterior surface of the outer container is prevented from approaching the temperature of the inner container. Goods surrounding a container according to the present invention are therefore prevented from being cooled or frozen inadvertently.

According to one embodiment of the present invention the outer ribs of the inner container project above the outer surface of the inner container with a rib height of 10 mm to 30 mm. Accordingly the spaces between the inner container and the outer container generated by these ribs have a height equal to or larger than the rib height between 10 mm and 30 mm.

According to one embodiment of the invention the outer ribs have a triangular or quadrangular cross section or a cross section in the form of a segment of a circle. However, the cross section of the ribs is not limited to these forms. The length, height, form, number and positioning of the outer ribs define the spaces between the inner and outer container and, therefore, the ventilation properties of the container design. A person skilled in the art can choose these parameters appropriately.

In one embodiment of the present invention the thermally insulating material, which the inner container contains, is a foamed plastics material. In another embodiment the inner container including its outer ribs is completely made of a foamed plastics material. The foamed plastics material is in one embodiment selected from the group of expandable polystyrene, polyurethane, polyethylene and polypropylene or any other applicable foamed plastics material known by those skilled in the art. The specific foam weight of the foamed plastics material is in one embodiment 15 to 30 g/l. The specific foam weight and the thickness of the walls of the inner container are chosen depending upon the desired insulating properties of the inner container.

In another embodiment of the present invention the outer container is a cardboard box. In one embodiment the outer container is of corrugated cardboard construction, but may alternatively comprise plastic, wood or other similar construction. A cardboard box has the advantages of being low-priced and easily labeled. The cutting of holes (like the ventilation holes according to the invention) into cardboard boxes does not demand a complicated technology.

In one embodiment the inner container of the container according to the invention is removable from the outer container, thereby e.g. allowing disposal of the outer container and reuse of the inner container in other outer containers, or for permitting separate disassembly and storage of the inner and outer containers.

In one embodiment the inner container comprises a cover in the form of a lid, which is frictionally engaged with the side walls of the inner container, when the inner container is closed with the cover. In one embodiment the outer container comprises flaps (in particular four flaps) which cooperate to form a cover, when the outer container is closed. The closed cover can be secured by strips of an adhesive tape.

The present invention further relates to a method for packaging goods in a container for a cooled transport of the goods, which in one embodiment comprises inserting the goods and a coolant into an inner container, the inner container containing a thermally insulating material and having an outer surface with outer ribs; and inserting the inner container into an outer container, the outer container having a plurality of ventilation holes for ventilating spaces between the inner container and the outer container, the spaces being generated by the outer ribs.

This method is carried out with a container according to any one of the embodiments of the invention as described above. The order of the packaging steps of:

- inserting the goods and a coolant into an inner container, the inner container containing a thermally insulating material and having an outer surface with outer ribs; and
- inserting the inner container into an outer container, the outer container having a plurality of ventilation holes for ventilating spaces between the inner container and the outer container, the spaces being generated by the outer ribs, is optional. The inner container can first be inserted into the outer container and then be filled with the goods and the coolant or the inner container can first be filled and then be inserted into the outer container.

The ventilation of the spaces between the inner container and the outer container takes place due to the automatic exchange of air between the surrounding and the spaces via the ventilation holes. The ventilation can be supported by an active circulation of the air in the surrounding of the container, e.g. in a shipping container.

The invention further refers to the use of a container according to the invention for transporting pharmaceutical or diagnostic products, especially diagnostic kits for the immunology, clinical chemistry or biochemistry. The container can also be used for transporting food.

The present invention is explained in greater detail below with reference to the drawing.

DETAILED DESCRIPTION

Figure 1:
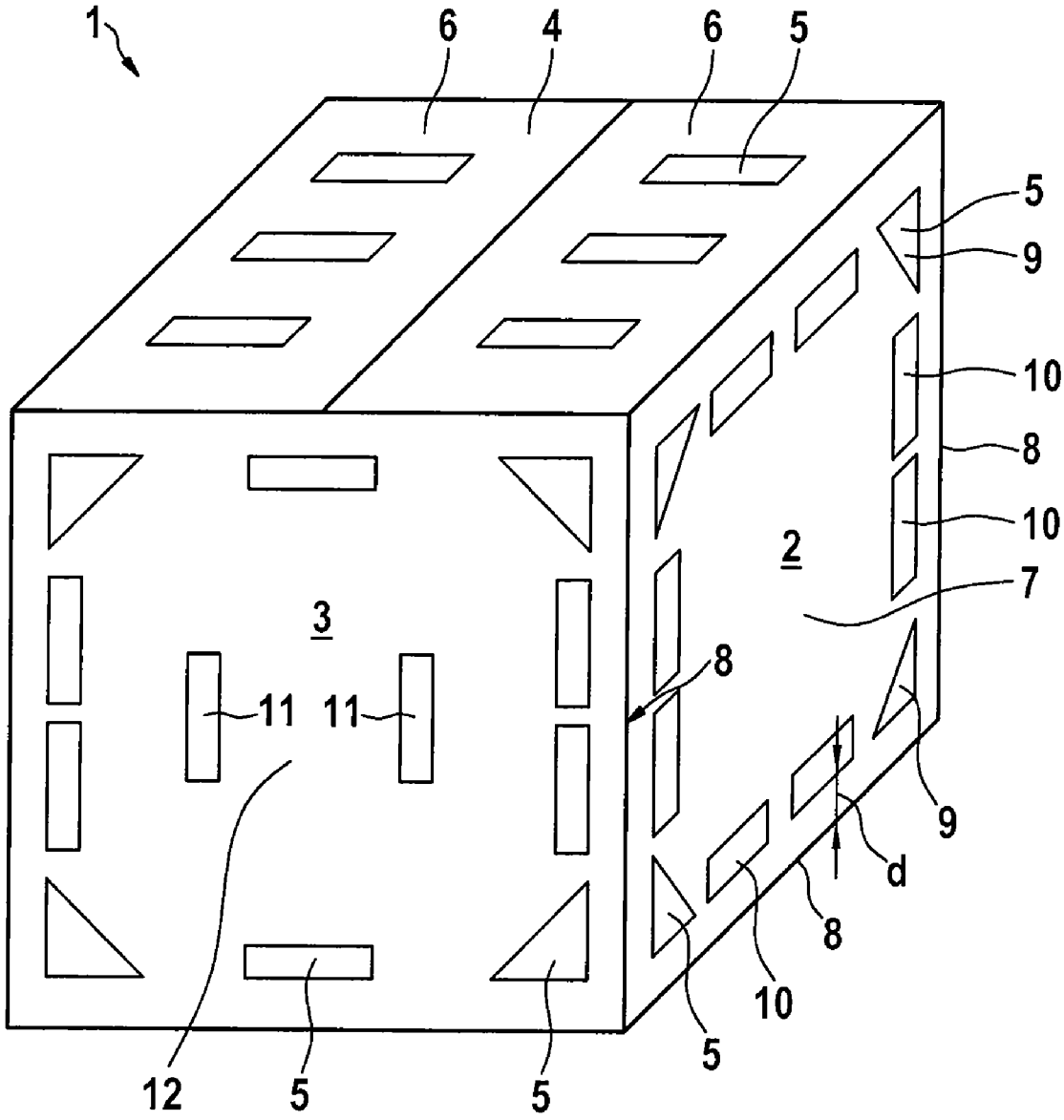
FIG. 1 shows schematically the outer container of a first embodiment of a container according to the present invention.

In FIG. 1 an outer container is shown in a perspective view from the outside.

Two side walls 2, 3 and the top 4 of the outer container 1 are visible in FIG. 1. In one embodiment the shown outer container 1 is a cardboard box. The outer container 1 has a plurality of ventilation holes 5 for allowing an air exchange between its inside and its outside. The ventilation holes 5 are distributed over all of the walls of the outer container, including its four side walls (2, 3), its base and its top 4. The top 4 contains six ventilation holes 5. It is constructed by two flaps 6, which are covering the outer container 1, each flap 6 containing three ventilation holes 5 aligned in the middle of each flap 6. The ventilation holes 5 of the top 4 are all of a rectangular form. The first side wall 2 (shown on the right side) contains twelve ventilation holes 5, which enframe the middle region 7 of the first side wall 2 with a small distance d from its edges 8. Four ventilation holes 5 in the four corners of the first side wall 2 are of a triangular form. Between every two triangular ventilation holes 9 of neighboring corners, two rectangular ventilation holes 10 are positioned.

The second side wall 3 (shown in the front) contains fourteen ventilation holes 5, twelve of which are arranged in a similar way as the ventilation holes 5 of the first side wall 2. Two additional rectangular ventilation holes 11 are placed in the middle region 12 of the second side wall 3.

Figure 2:
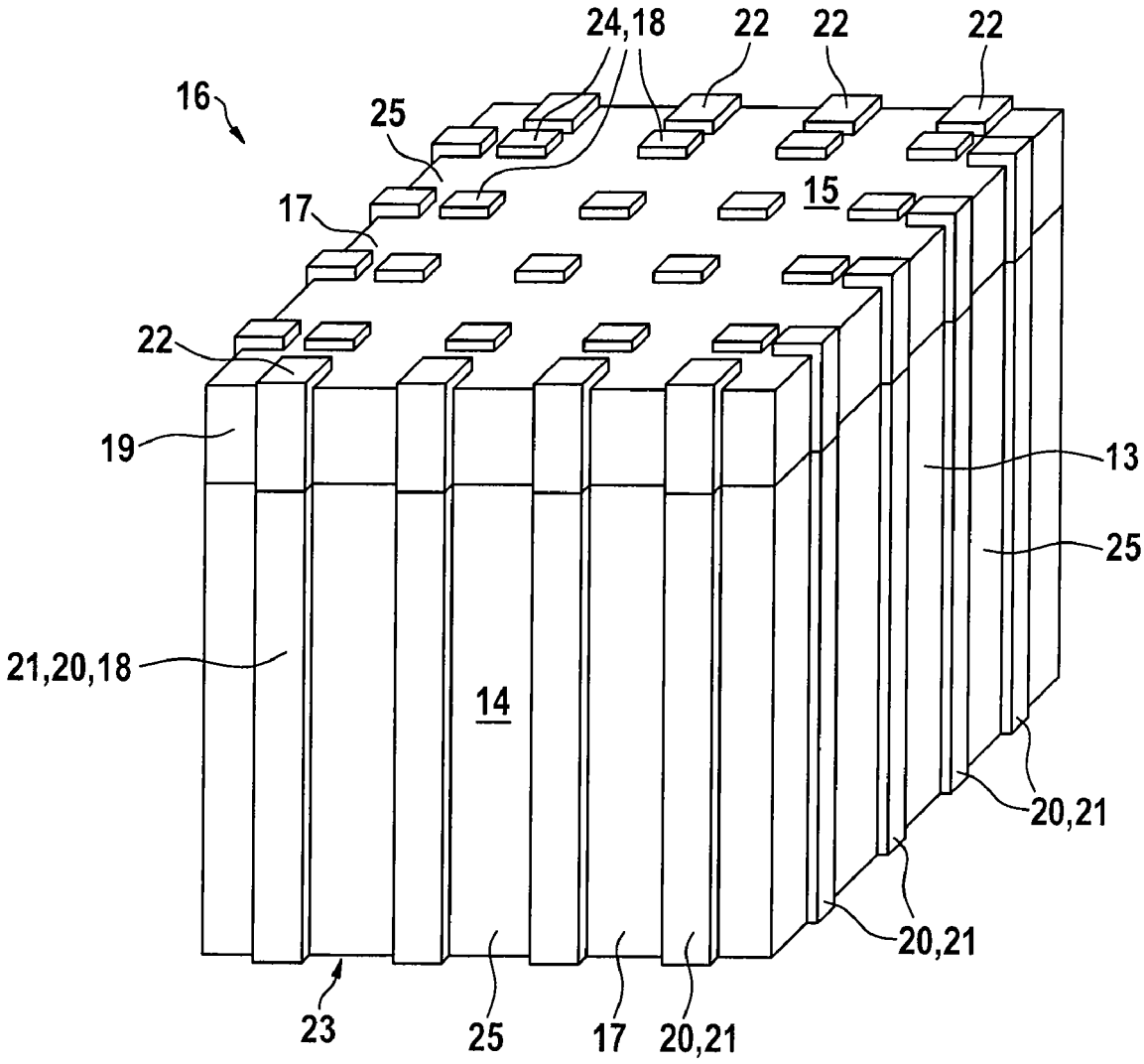
FIG. 2 shows schematically the inner container of a first embodiment of a container according to the present invention.

The outer container 1 as shown in FIG. 1 is designed to accommodate an inner container as shown in FIG. 2.

In FIG. 2 an inner container is shown in a perspective view from the outside.

Two side walls 13, 14 and the top 15 of the inner container 16 are visible in FIG. 2. In one embodiment the shown inner container 16 is made of a thermally insulating foamed plastics material, and in another embodiment of expanded polystyrene. The inner container 16 has an outer surface 17 on which outer ribs are arranged. When the inner container 16 as shown in FIG. 2 is placed within an outer container 1 as shown in FIG. 1, the outer ribs 18 have the function of spacers, generating spaces between the inner container 16 and the outer container 1, which are ventilated via the ventilation holes 5 of the outer container 1.

The inner container 16 according to FIG. 2 is closed by a lid 19, which covers its top 15. All of the outer ribs 18 have a rectangular cross section. The four outer ribs 20, which are arranged on each side wall 13, 14 of the inner container 16, run in the form of bars 21 from bottom to top of the respective side wall 13, 14. These bars 21 are resumed by sixteen square ribs 22 at the edge of the top 15 and the base 23 (not shown). Furthermore, the top 15 has another sixteen square ribs 24, which are evenly distributed over its surface 17. The base 23 is in one embodiment designed similarly. The rib height of all of the outer ribs of the inner container 16 according to FIG. 2 is in one embodiment 10 mm.

When an inner container 16 according to FIG. 2 is placed within an outer container 1 according to FIG. 1 to form a container for transporting cooled goods according to the invention, the outer ribs 18 of the inner container 16 abut the inner surfaces of the outer container 1 at positions, where no ventilation holes 5 are arranged. The positions of the ribs 18 are shifted with respect to the ventilation holes 5. In the regions 25 of the outer surface 17 of the inner container 16 without outer ribs 18 spaces are formed between the inner container 16 and the outer container 1, which are ventilated via the ventilation holes 5 of the outer container 1.

Figure 3:
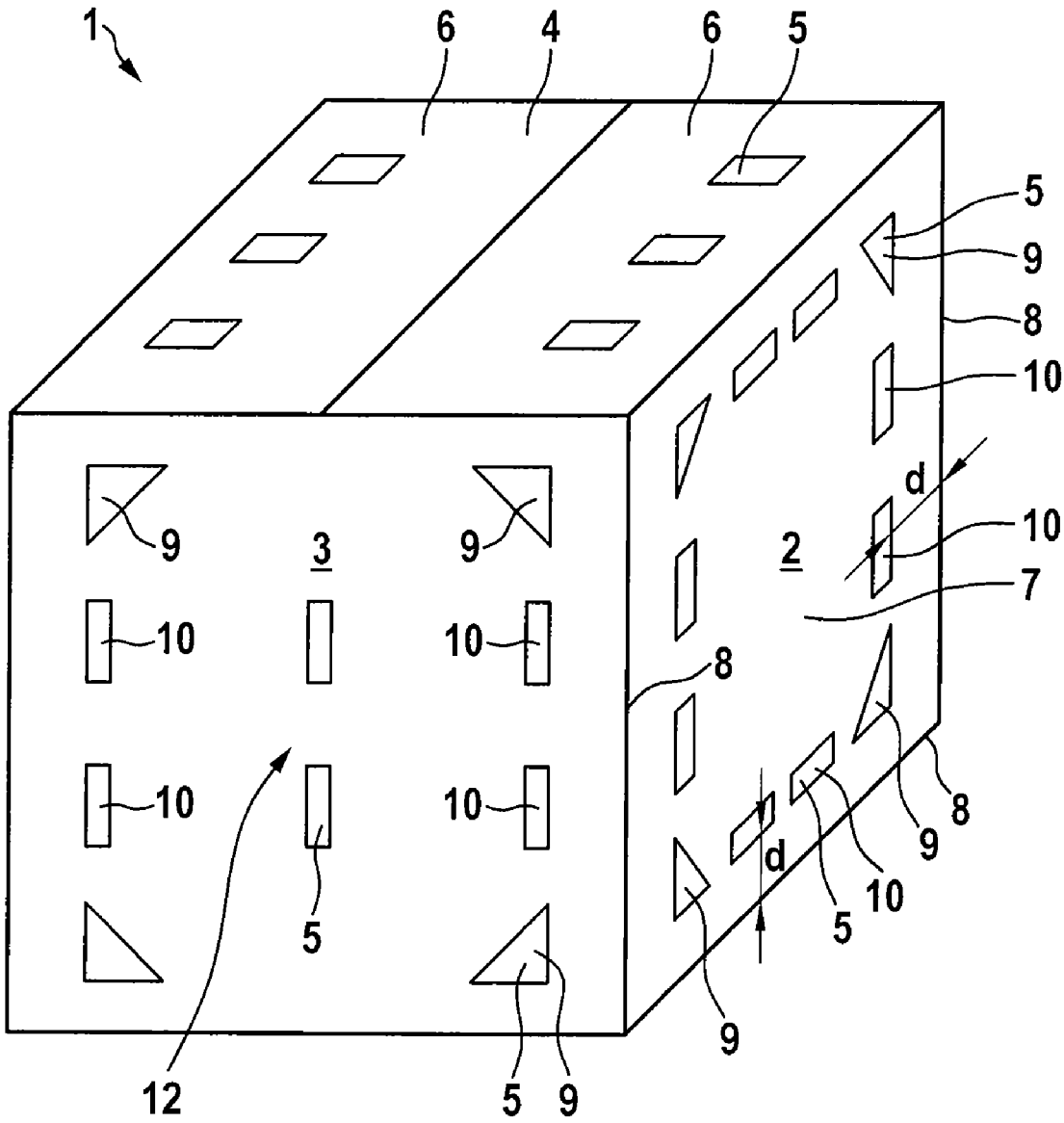
FIG. 3 shows schematically the outer container of a second embodiment of a container according to the present invention.

In FIG. 3 an outer container is shown in a perspective view from the outside.

Two side walls 2, 3 and the top 4 of the outer container 1 are visible in FIG. 3. In one embodiment the shown outer container 1 is a cardboard box. The outer dimensions of the outer container are e.g. 770×595×710 $mm^3$ (quality 2.60 BC). The outer container 1 has a plurality of ventilation holes 5 for allowing an air exchange between its inside and its outside. The ventilation holes 5 are distributed over all of the walls of the outer container, including its four side walls (2, 3), its base and its top 4. The top 4 contains six ventilation holes 5. It is constructed by two flaps 6, which are covering the outer container 1, each flap 6 containing three ventilation holes, which are aligned on each flap 6. The ventilation holes 5 of the top 4 are all of a rectangular form. The first side wall 2 (shown on the right side) contains twelve ventilation holes 5, which enframe the middle region 7 of the first side wall 2 with a distance d from its edges 8. Four ventilation holes 5 in the four corners of the first side wall 2 are of a triangular form. Between every two triangular ventilation holes 9 of neighboring corners, two rectangular ventilation holes 10 are positioned.

The second side wall 3 (shown in the front) contains ten ventilation holes 5. In each of the four corners of the second side wall 3 a triangular ventilation hole 9 is positioned. Four rectangular ventilation holes 10 are aligned two and two along two opposite edges of the second side wall 3. Two additional rectangular ventilation holes 11 are placed in the middle region 12 of the second side wall 3.

Figure 4:
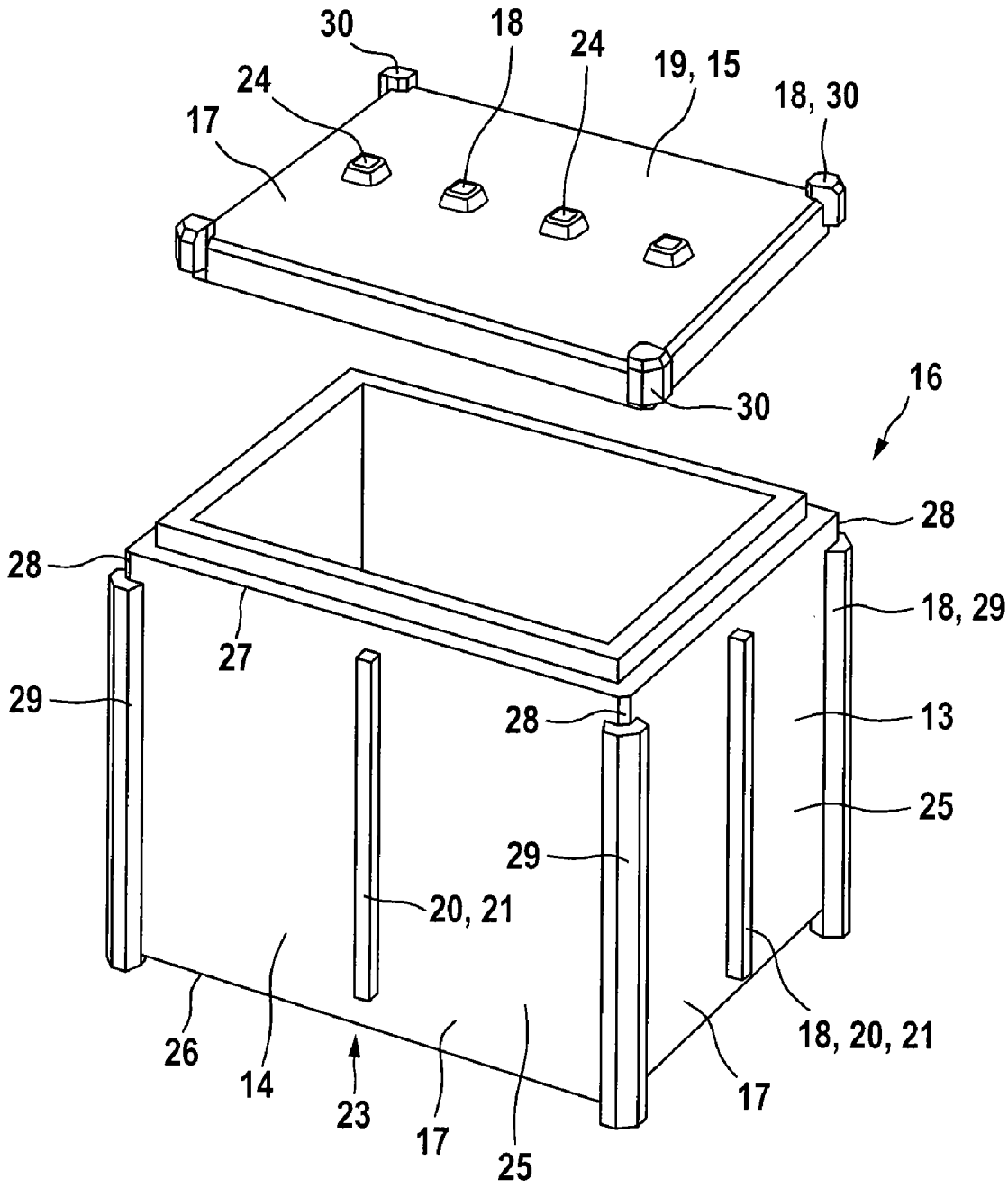
FIG. 4 shows schematically the inner container of a second embodiment of a container according to the present invention.

The outer container 1 as shown in FIG. 3 is designed to accommodate an inner container as shown in FIG. 4.

In FIG. 4 an inner container is shown in a perspective view from the outside.

Two side walls 13, 14 and the lid 19 forming the top 15 of the inner container 16 are visible in FIG. 4. In one embodiment the shown inner container 16 is made of a thermally insulating foamed plastics material, and in another embodiment of expanded polystyrene. The inner container 16 has an outer surface 17 on which outer ribs are arranged. The outer dimensions of the inner container 16 are e.g. 751×576×677 $mm^3$ including the ribs. When the inner container 16 as shown in FIG. 4 is placed within an outer container 1 as shown in FIG. 3, the outer ribs 18 have the function of spacers, generating spaces between the inner container 16 and the outer container 1, which are ventilated via the ventilation holes 5 of the outer container 1.

The inner container 16 according to FIG. 4 is closed by a lid 19, which covers its top 15. One outer rib 20, which is arranged on each side wall 13, 14 of the inner container 16, runs in the form of a bar 21 from bottom to top in the middle of the respective side wall 13, 14, starting and ending in a small distance to the bottom and top edges 26, 27. These bars 21 have a rectangular cross section. The four side edges 28 are covered by an edge rib 29 each, which is continued by four corner ribs 30 of the lid 19, and which protrudes by a small length over the base 23. Each edge rib 29 is bent around one of the four side edges 28. Furthermore, the top 15 has another four square ribs 24, which are aligned in the middle of its surface 17. The base 23 is in one embodiment designed similarly. The rib height of all of the outer ribs of the inner container 16 according to FIG. 4 is in one embodiment 20 mm.

When an inner container 16 according to FIG. 4 is placed within an outer container 1 according to FIG. 3 to form a container for transporting cooled goods according to the invention, the outer ribs 18 of the inner container 16 abut the inner surfaces of the outer container 1. In the regions 25 of the outer surface 17 of the inner container 16 without outer ribs 18 spaces are formed between the inner container 16 and the outer container 1, which are ventilated via the ventilation holes 5 of the outer container 1.

EXAMPLES

A container according to the present invention with an outer container according to FIG. 1 and an inner container according to FIG. 2 was tested. The inner container was made of polystyrene with the outer dimensions 715×580×640 $mm^3$ including the ribs and had ribs of 10 mm height and 10 mm width arranged on its outer surface. The specific foam weight of the polystyrene was 20 g/l. The outer container was a cardboard box with a plurality of ventilation holes with the outer dimensions 736×597×673 $mm^3$ (quality 2.60 BC). Two tests were carried out with the container according to the invention, the first test within a cold-storage container with an inside temperature of 3.5 to 4° C. and the second test within a room of about 20° C. In both tests the container was filled with 30 kg of dry ice (with a temperature of −78.5° C.). A smaller cardboard box filled with 17 sample packages was placed successively in contact with a) a long side of the container, b) a narrow side of the container, and c) the cover of the container, allowing heat energy to be transferred from the actually contacting walls of the smaller cardboard box to the outer surface of the container according to the invention. The sample packages were filled with diagnostic kits, which had a temperature between 2° C. and 8° C., when they were placed in the smaller cardboard box. A temperature recorder was connected to the inside of the wall of the smaller cardboard box, which touched the container at its outside.

In test 1 (surrounding temperature of 3.4 to 4° C.) the inner wall of the smaller cardboard box adapted a temperature of 0° C. to 1° C. in all three different arrangements a) to c) within the first 2 days. In test 2 (surrounding temperature of about 20° C.) the inner wall of the smaller cardboard box adapted a temperature of a) 12° C. to 18° C., b) 12° C. to 17° C. and c) 9° C. to 17° C. within the first 2 days.

Therefore, in both tests the inside of the smaller cardboard box was only cooled down by a few degrees Celsius. Particularly, it was not cooled down below the freezing point. The container according to the invention was thus capable of preventing an unwanted cooling of freezing of neighboring goods via its outer surface.

What is claimed is:

1. A container for transporting cooled goods comprising an inner container for receiving the cooled goods and an outer container surrounding the inner container wherein the inner container contains a thermally insulating material, wherein the insulating material is a foamed plastics material, and has an outer surface thereof on which the outer surface outer ribs are arranged, the outer ribs generating spaces between the inner container and the outer container, and wherein the outer container is a cardboard box which has a plurality of ventilation holes on two or more surfaces for ventilating the spaces.

2. A container according to claim 1, wherein the outer ribs of the inner container abut an inner surface of the outer container.

3. A container according to claim 1, wherein the outer ribs project above the outer surface of the inner container with a rib height between 10 mm and 30 mm.

4. A container according to claim 1, wherein the outer ribs have a triangular or quadrangular cross section or a cross section in the form of a segment of a circle.

5. A container according to claim 1, wherein the outer ribs are arranged at positions, which are shifted with respect to the ventilation holes.

6. A container according to claim 1, wherein the inner container is removable from the outer container.

7. A method for transporting a product, comprising utilizing a container according to claim 1 wherein the product comprises one of a pharmaceutical product, a diagnostic product, and a food.

8. A method for packaging goods in a container for a cooled transport of the goods comprising:

inserting the goods and a coolant into an inner container, the inner container containing a thermally insulating material, wherein the insulating material is a foamed plastics material, and having an outer surface with outer ribs; and inserting the inner container into an outer container such that the outer container surrounds the inner container, the outer container being a cardboard box having a plurality of ventilation holes on two or more surfaces for ventilating spaces between the inner container and the outer container, the spaces being generated by the outer ribs.

* * * * *